US006739489B1

(12) United States Patent
Nicolai et al.

(10) Patent No.: US 6,739,489 B1
(45) Date of Patent: May 25, 2004

(54) SEGMENTED VACUUM ROLL

(75) Inventors: Luc Marie Hubert Andre Nicolai, Heinsch (BE); Gilles Petitjean, Arlon (BE); Jos Marnach, Luxembourg (LU)

(73) Assignee: DuPont Teijin Films U.S., Wilmington, DE (US)

( * ) Notice: Subject to any disclaimer, the term of this patent is extended or adjusted under 35 U.S.C. 154(b) by 0 days.

(21) Appl. No.: 10/018,389

(22) PCT Filed: Jun. 14, 2000

(86) PCT No.: PCT/EP00/05435

§ 371 (c)(1),
(2), (4) Date: Apr. 16, 2002

(87) PCT Pub. No.: WO00/76896

PCT Pub. Date: Dec. 21, 2000

(30) Foreign Application Priority Data

Jun. 16, 1999 (EP) ..... 99401485

(51) Int. Cl.[7] ..... B65H 20/00
(52) U.S. Cl. ..... 226/95; 226/110
(58) Field of Search ..... 226/95, 110, 111, 226/188

(56) References Cited

U.S. PATENT DOCUMENTS 3,125,265 A * 3/1964 Warren et al. ..... 226/95
3,549,098 A * 12/1970 Helkala ..... 242/542.4
3,586,225 A * 6/1971 Takata ..... 226/95
3,587,962 A * 6/1971 Herzhoff et al. ..... 226/95
5,915,648 A * 6/1999 Madrzak et al. ..... 226/95
6,250,581 B1 * 6/2001 Cramer ..... 226/95
6,328,194 B1 * 12/2001 Meschenmoser ..... 226/95
6,427,941 B1 * 8/2002 Hikita ..... 242/615.12

FOREIGN PATENT DOCUMENTS

FR 708853 * 7/1931
FR 2202507 * 3/1974

* cited by examiner

*Primary Examiner*—Kathy Matecki
*Assistant Examiner*—Evan Langdon

(57) ABSTRACT

A segmented vacuum roll comprising an inner assembly on which a plurality of cylindrical sleeve tubes (2*a*, 2*b*, 2*c*) having apertures over their circumference are rotatably and coaxially mounted side by side, each of said sleeve tubes being individually rotatable and one or several first chambers (9*a*, 9*b*, 9*c*) formed in said inner assembly and partly defined by a first portion of circumference of said sleeve tubes, said inner assembly comprising linking channels (6*a*, 6*b*, 6*c*) for linking a vacuum source to said chambers so that said first portion of circumference of said sleeve tubes may be submitted to vacuum. Said inner assembly comprises an inner tube (3), at least one outer tube (5*a*, 5*b*, 5*c*) surrounding said inner tube and a plurality of longitudinal walls extending between said inner tube and said outer tube so as to form longitudinal channels (6*a*, 6*b*, 6*c*).

17 Claims, 7 Drawing Sheets

SEGMENTED VACUUM ROLL

FIELD OF THE INVENTION

The invention relates to a vacuum roll for conveying webs and, more particularly, to a vacuum roll having several segments each of which being able to convey a separate web resulting, for instance, from a main web split into several webs of smaller wide.

BACKGROUND OF THE INVENTION

Webs such as polymeric foils (like polyester foils) or other sheet materials are manufactured in a continuous process and the final products are wound up on rolls for storage and transportation. On such production lines or on converting rewinding machines, vacuum rolls may be used to transport, pull, guide (or even dry) the web.

Those vacuum rolls are known in the art for a long time.

However, on the production line or on a converting equipment, the web may be split into several lanes and each lane may have to be transported, pulled or guided individually, at a speed different from the speed of the other lanes.

SUMMARY OF THE INVENTION

The object of the present invention is to provide a segmented vacuum roll each segment of which is rotatable independently from the other segments so that each segment drives a respective web at an own speed according to the need of the process.

DETAILED DESCRIPTION OF THE INVENTION

Figure 1A:
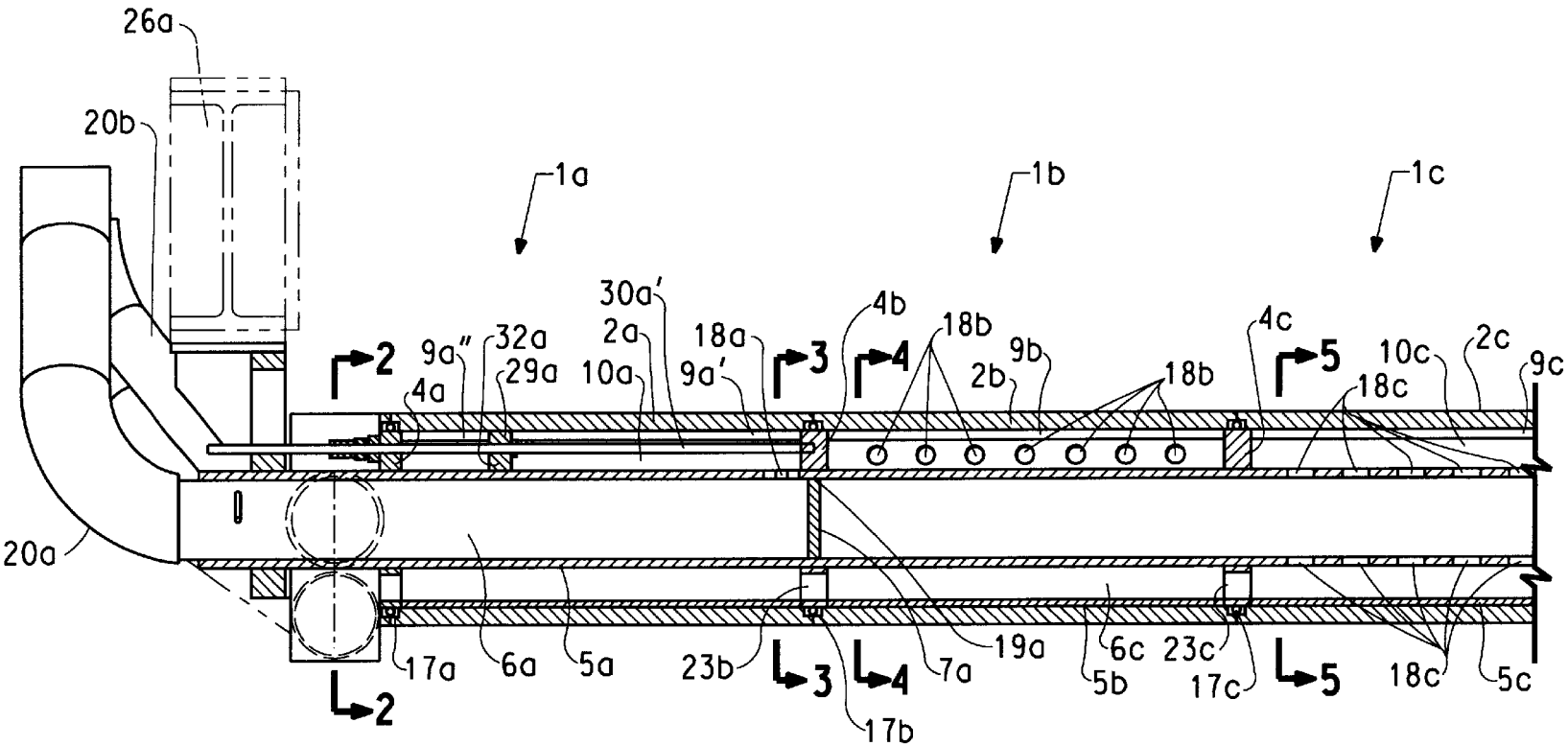
FIGS. 1*a* and 1*b* schematically show respectively the left half and the right half of a longitudinal section according to line 1*a*1*b*—1*a*1*b* shown in FIG. 2 of a segmented vacuum roll according to the invention.
Figure 1B:
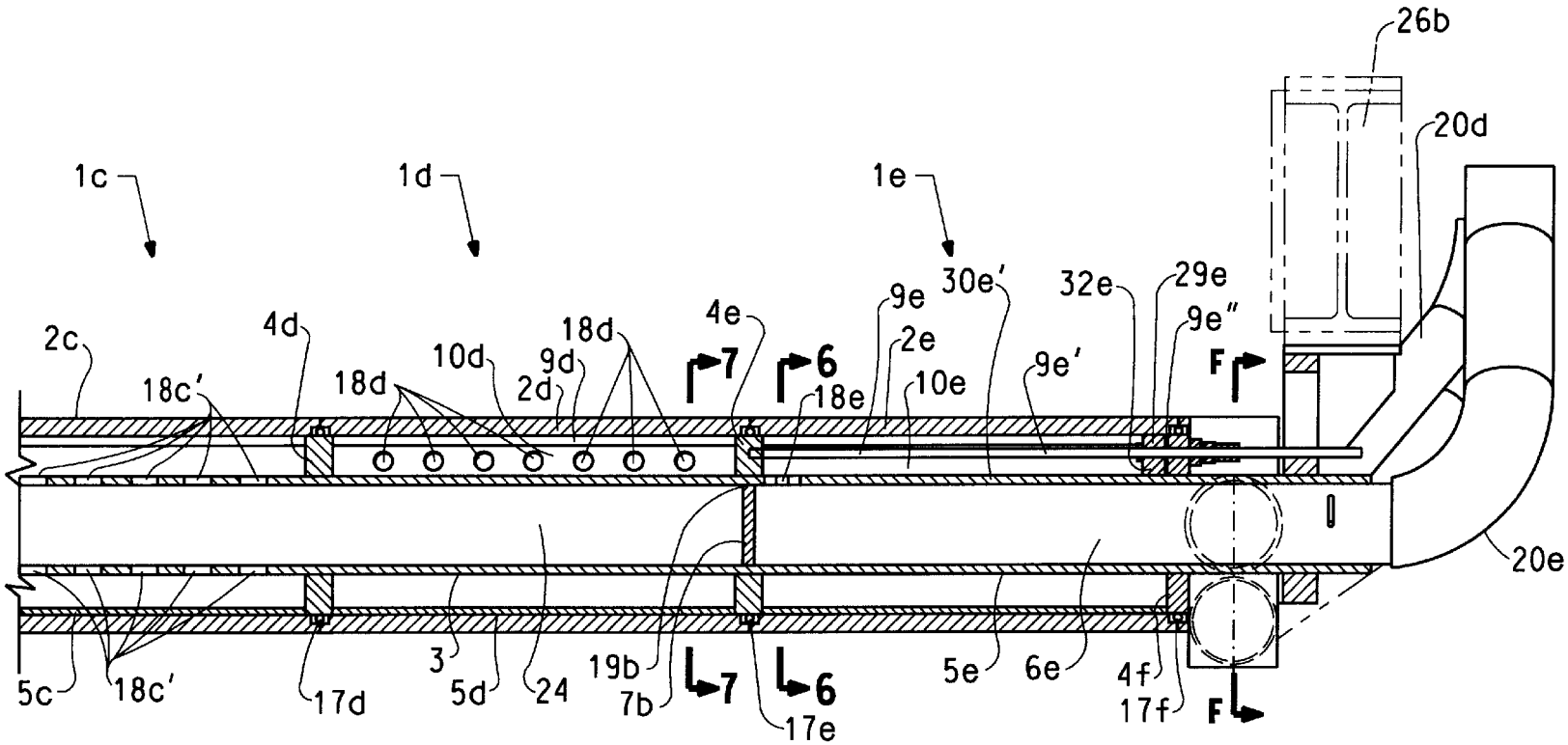
Figure 2:
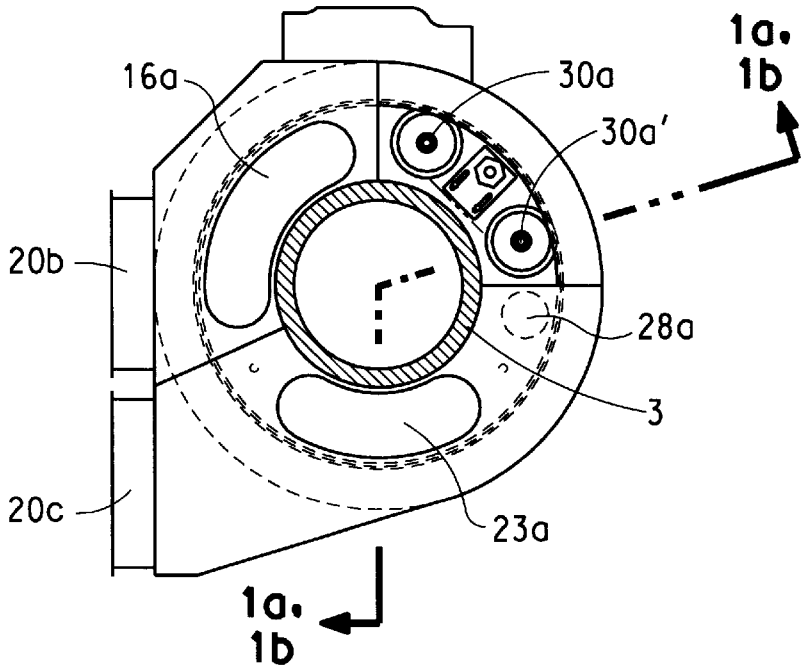
FIG. 2 schematically shows a cross section of the segmented vacuum roll of FIG. 1 according to line 2—2.

FIGS. 1*a* and 1*b* show respectively the left half and the right half of a longitudinal section of a segmented vacuum roll according to a preferred embodiment of the invention. The segmented vacuum roll comprises five segments 1*a*, 1*b*, 1*c*, 1*d* and 1*e* disposed side by side. The segmented vacuum roll is based on a common fixed inner assembly on which are rotatably mounted side by side five sleeve tubes 2*a*, 2*b*, 2*c*, 2*d* and 2*e* corresponding each to a respective segment 1*a*, 1*b*, 1*c*, 1*d* and 1*e*. Those sleeve tubes 2*a*, 2*b*, 2*c*, 2*d* and 2*e* preferably have the same inner and outer diameter and have each a quantity of apertures or perforations over their whole surface through which the vacuum effect will be exerted. Said perforations may be of any type (holes, slots) and size (microscopic or macroscopic). Sleeve tubes 2*a*, 2*b*, 2*c*, 2*d* and 2*e* are known per se. The segmented vacuum roll comprises at each end a support 26*a*, respectively 26*b* for mounting purpose.

For each segment 1*a*, 1*b*, 1*c*, 1*d* and 1*e*, the common inner assembly forms a respective chamber 9*a*, 9*b*, 9*c*, 9*d* and 9*e* one wall of which is formed by a portion of the corresponding sleeve tube 2*a*, 2*b*, 2*c*, 2*d* and 2*e*. Each chamber 9*a*, 9*b*, 9*c*, 9*d* and 9*e* is connected to a respective vacuum generator via a respective channel 6*a*, 6*b*, 6*c*, 6*d* and 6*e*. To form said chambers 9*a*, 9*b*, 9*c*, 9*d* and 9*e* and said channels 6*a*, 6*b*, 6*c*, 6*d* and 6*e*, the inner assembly comprises an inner tube 3 passing through the whole segmented vacuum roll and five outer tubes 5*a*, 5*b*, 5*c*, 5*d* and 5*e* mounted side by side and coaxial on inner tube 3 as well as several longitudinal walls between them and separating disks. Inner tube 3 and outer tubes 5*a*, 5*b*, 5*c*, 5*d* and 5*e* have preferably a cylindrical cross section.

We will now describe each segment 1*a*, 1*b*, 1*c*, 1*d* and 1*e*.

Figure 3:
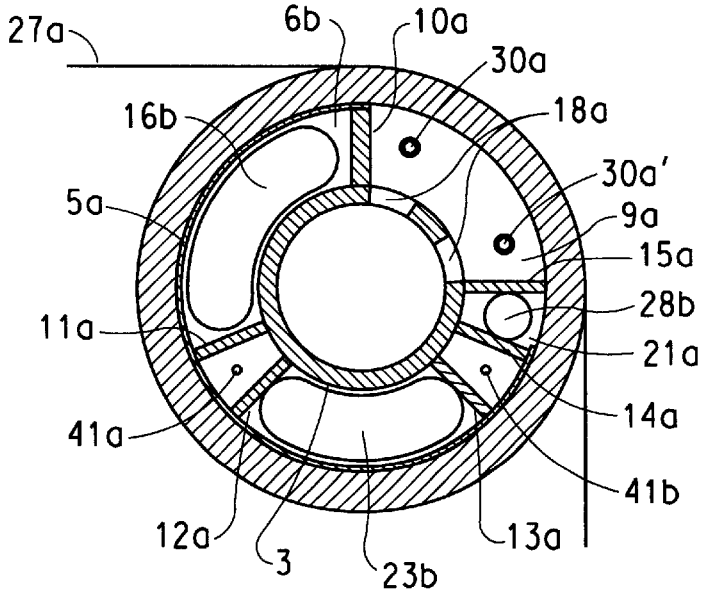
FIG. 3 schematically shows a cross section of the segmented vacuum roll of FIG. 1 according to line 3—3.
Figure 4:
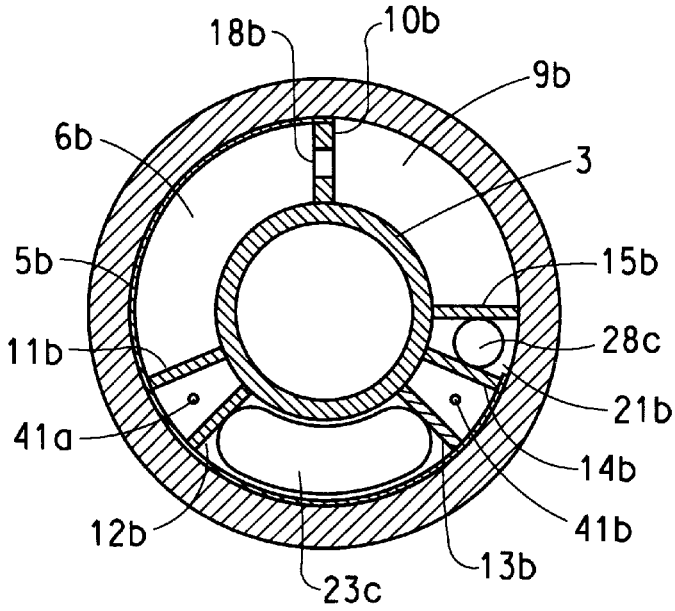
FIG. 4 schematically shows a cross section of the segmented vacuum roll of FIG. 1 according to line 4—4.
Figure 5:
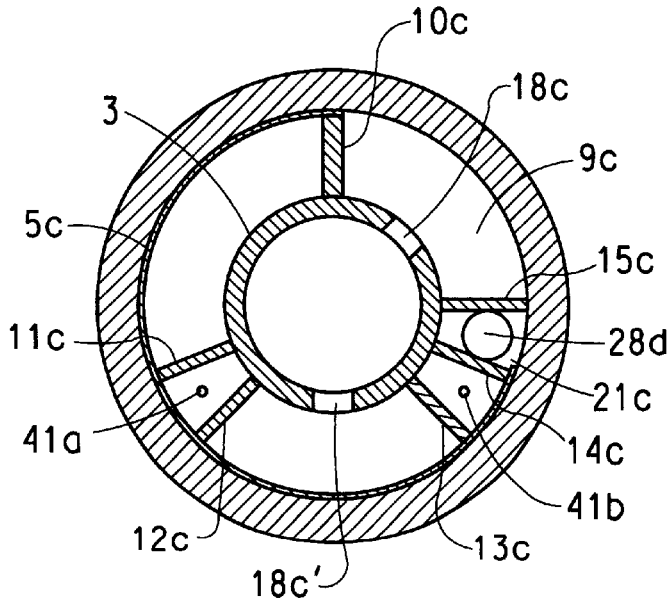
FIG. 5 schematically shows a cross section of the segmented vacuum roll of FIG. 1 according to line 5—5.

First segment 1*a* will be described in relation with FIGS. 1*a* and 3.

First segment 1*a* comprises sleeve tube 2*a*. Sleeve tube 2*a* is rotatably mounted by each end on inner tube 3 via an end disk 4*a* on the free end side of the segmented vacuum roll and via a separator disk 4*b* on the side towards second segment 1*b*. End disk 4*a* as well as separator disk 4*b* have a central hole corresponding substantially to the outer diameter of inner tube 3 so that they may be mounted on the latter. The joint between end disk 4*a* and inner tube 3 and the joint between separator disk 4*b* and inner tube 3 are preferably welded in a substantially sealed manner. Sleeve tube 2*a* is rotatably mounted on end disk 4*a* and separator disk 4*b* via respectively a ball bearing 17*a* and a first ball bearing 17*b*.

Outer tube 5*a* is mounted coaxial on inner tube 3 between end disk 4*a* and separator disk 4*b*. Outer tube 5*a* has preferably substantially the same outer diameter than end disk 4*a* and separator disk 4*b*, but it could also be smaller. As a result, sleeve tube 2*a* surrounds also outer tube 5*a*. Five longitudinal walls 10*a*, 11*a*, 12*a*, 13*a*, and 14*a* extend preferably radially between inner tube 3 and outer tube 5*a* in spaced relationship from one another around the circumference of inner tube 3. The circumference portion of outer tube 5*a* comprised between wall 10*a* and wall 14*a* is omitted so that the space comprised between wall 10*a* and wall 14*a* is limited in outward direction by the corresponding circumference portion of sleeve tube 2*a*. A further longitudinal wall 15*a* extending preferably radially is arranged on inner tube 3 between wall 10*a* and 14*a*. Walls 10*a*, 11*a*, 12*a*, 13*a*, 14*a* and 15*a* extend longitudinally from end disk 4*a* to separator disk 4*b*.

The space between wall 10*a* and wall 15*a* and limited radially by the corresponding portion of inner tube 3 and sleeve tube 2*a* defines chamber 9*a*. The space between wall 15*a* and wall 14*a* and limited radially by the corresponding portion of inner tube 3 and sleeve tube 2*a* defines a chamber 21*a*. Preferably, said walls 10*a*, 11*a*, 12*a*, 13*a*, 14*a* and 15*a* are welded on inner tube 3 as well as on end disk 4*a* and separator disk 4*b* and are glued on outer tube 5*a*, both in a substantially sealed manner. Thus, the space defined between two successive walls (chosen among walls 10*a*,

11*a*, 12*a*, 13*a* and 14*a*) as well as the portions of inner tube 3 and outer tube 5*a* comprised between the latter forms a channel usable to transmit vacuum if relevant.

Two holes 18*a* are arranged on inner tube 3 between walls 10*a* and 15*a* so that chamber 9*a* communicates with the inside of inner tube 3. A separator disk 7*a* is arranged in press fit manner inside of inner tube 3 at substantially the same longitudinal level than separator disk 4*b* mounted outside of inner tube 3. Preferably, a seal 19*a* is disposed in a groove arranged on the circumference of separator disk 7*a* in order to provide a sealing between separator disk 7*a* and inner tube 3. The inside of inner tube 3 corresponding to the segment 1*a* side (i.e. the portion of inner tube 3 extending from separator disk 7*a* towards the end of inner tube 3 on the side of end disk 4*a*) forms channel 6*a* connected at its free end to a vacuum generator (not shown) via a sleeve 20*a*. Thus, vacuum is transmitted from said vacuum generator to chamber 9*a* successively through sleeve 20*a*, channel 6*a* and holes 18*a*. As already mentioned, chamber 9*a* is delimited in outward direction by a circumference portion of sleeve tube 2*a* which is perforated. As a consequence, the vacuum effect will be exerted through the perforations of that circumference portion, i.e. it is the active portion of segment 1*a* of the segmented vacuum roll. On the other hand, no vacuum effect is exerted on the remaining circumference portion of sleeve tube 2*a*. Of course, the gap between sleeve tube 2*a* and outer tube 5*a* taken at the level of wall 10*a* is preferably minimized in order to avoid vacuum leakage. Similarly, the gap between sleeve tube 2*a* and wall 15*a* is also preferably minimized for the same reason.

As a result, when a web is placed on segment 1*a*, it will be sucked onto the active portion of sleeve tube 2*a* through the action of vacuum existing in chamber 9*a*. Further, when sleeve tube 2*a* is caused to rotate, it will drive the web. The means for causing sleeve tube 2*a* to rotate will be described later.

Second segment 1*b* will be described in relation with FIGS. 1*a*, 2, 3 and 4.

Second segment 1*b* comprises sleeve tube 2*b*. Sleeve tube 2*b* is rotatably mounted by each end on inner tube 3 via separator disk 4*b* on the side towards first segment 1*a* and via a separator disk 4*c* on the side towards third segment 1*c*. Separator disk 4*c* has a central hole corresponding substantially to the outer diameter of inner tube 3 so that it may be mounted on the latter. The joint between separator disk 4*c* and inner tube 3 is preferably welded in a substantially sealed manner. Sleeve tube 2*b* is rotatably mounted on separator disk 4*b* via a second ball bearing 17*b* arranged aside first ball bearing 17*b* which supports sleeve tube 2*a*. Sleeve tube 2*b* is further rotatably mounted on separator disk 4*c* via a first ball bearing 17*c*.

Outer tube 5*b* is mounted coaxially on inner tube 3 between separator disk 4*b* and separator disk 4*c*. Outer tube 5*b* has preferably substantially the same outer diameter than separator disks 4*b* and 4*c*, but it could also be smaller. As a result, sleeve tube 2*b* surrounds also outer tube 5*b*. Five longitudinal walls 10*b*, 11*b*, 12*b*, 13*b* and 14*b* extend preferably radially between inner tube 3 and outer tube 5*b* in spaced relationship from one another around the circumference of inner tube 3. The circumference portion of outer tube 5*b* comprised between wall 10*b* and wall 14*b* is omitted so that the space comprised between wall 10*b* and wall 14*b* is limited in outward direction by the corresponding circumference portion of sleeve tube 2*b*. A further longitudinal wall 15*b* extending preferably radially is arranged on inner tube 3 between wall 10*b* and 14*b*. Walls 10*b*, 11*b*, 12*b*, 13*b*, 14*b* and 15*b* extend longitudinally from separator disk 4*b* to separator disk 4*c*. Further, walls 10*b*, 11*b*, 12*b*, 13*b*, 14*b* and 15*b* are substantially aligned respectively with walls 10*a*, 11*a*, 12*a*, 13*a*, 14*a* and 15*a*.

The space between wall 10*b* and wall 15*b* limited radially by the corresponding portions of inner tube 3 and sleeve tube 2*b* defines chamber 9*b*. The space between wall 15*b* and wall 14*b* limited radially by the corresponding portion of inner tube 3 and sleeve tube 2*b* defines a chamber 21*b*. Preferably, said walls 10*b*, 11*b*, 12*b*, 13*b*, 14*b* and 15*b* are welded on inner tube 3 as well as on separator disk 4*b* and separator disk 4*c* and are glued on outer tube 5*b*, both in a substantially sealed manner. Thus, the space defined between two successive walls (chosen among walls 10*b*, 11*b*, 12*b*, 13*b* and 14*b*) as well as the portions of inner tube 3 and outer tube 5*b* comprised between the latter forms a channel usable to transmit vacuum if relevant.

A curved oblong hole 16*b* is arranged in separator disk 4*b* between, on one hand, wall 10*a* and wall 10*b* and, on the other hand, wall 11*a* and wall 11*b*. Thus, the space between walls 10*a* and 11*a* and walls 10*b* and 11*b* limited radially by the corresponding portions of inner tube 3 and respectively outer tubes 5*a* and 5*b* defines channel 6*b* extending longitudinally from separator disk 4*c* to end disk 4*a*. Several holes 18*b* are arranged in wall 10*b* allowing channel 6*b* to communicate with chamber 9*b*. A curved oblong hole 16*a* is arranged in end disk 4*a* between wall 10*a* and wall 11*a*. An adapter 20*b* is mounted on the end of the segmented vacuum roll on the end disk 4*a* side which puts in communication hole 16*a* with an external vacuum generator (not shown). Thus, vacuum is transmitted from said vacuum generator to chamber 9*b* successively through hole 16*a*, channel 6*b* (comprising hole 16*b*) and holes 18*b*. As already mentioned, chamber 9*b* is delimited in outward direction by a circumference portion of sleeve tube 2*b* which is perforated. As a consequence, the vacuum effect will be exerted through the perforations of that circumference portion, i.e. it is the active portion of segment 1*b* of the segmented vacuum roll. On the other hand, no vacuum effect is exerted on the remaining circumference portion of sleeve tube 2*a*. Of course, the gap between sleeve tube 2*b* and outer tube 5*b* taken at the level of wall 10*b* is preferably minimized in order to avoid vacuum leakage. Similarly, the gap between sleeve tube 2*b* and wall 15*b* is also preferably minimized for the same reason.

As a result, when a web is placed on segment 1*b*, it will be sucked onto the active portion of sleeve tube 2*b* through the action of vacuum existing in chamber 9*b*. Further, when sleeve tube 2*b* is caused to rotate, it will drive the web. The means for causing sleeve tube 2*b* to rotate will be described later.

Third segment 1*c* will be described in relation with FIGS. 1*a*, 1*b*, 2, 3, 4 and 5.

Third segment 1*c* comprises sleeve tube 2*c*. Sleeve tube 2*c* is rotatably mounted by each end on inner tube 3 via separator disk 4*c* on the side towards second segment 1*b* and via a separator disk 4*d* on the side towards fourth segment 1*d*. Separator disk 4*d* has a central hole corresponding substantially to the outer diameter of inner tube 3 so that it may be mounted on the latter. The joint between separator disk 4*d* and inner tube 3 is preferably welded in a substantially sealed manner. Sleeve tube 2*c* is rotatably mounted on separator disk 4*c* via a second ball bearing 17*c* arranged aside first ball bearing 17*c* which supports sleeve tube 2*b*. Sleeve tube 2*c* is further rotatably mounted on separator disk 4*d* via a first ball bearing 17*d*.

Outer tube 5*c* is mounted coaxially on inner tube 3 between separator disk 4*c* and separator disk 4*d*. Outer tube 5*c* has preferably substantially the same outer diameter than separator disks 4*c* and 4*d*, but it could also be smaller. As a result, sleeve tube 2*c* surrounds also outer tube 5*c*. Five longitudinal walls 10*c*, 11*c*, 12*c*, 13*c* and 14*c* extend preferably radially between inner tube 3 and outer tube 5*c* in spaced relationship from one another around the circumference of inner tube 3. The circumference portion of outer tube 5*c* comprised between wall 10*c* and wall 14*c* is omitted so that the space comprised between wall 10*c* and wall 14*c* is limited in outward direction by the corresponding circumference portion of sleeve tube 2*c*. A further longitudinal wall 15*c* extending preferably radially is arranged on inner tube 3 between walls 10*c* and 14*c*. Walls 10*c*, 11*c*, 12*c*, 13*c*, 14*c* and 15*c* extend longitudinally from separator disk 4*c* to separator disk 4*d*. Further, walls 10*c*, 11*c*, 12*c*, 13*c*, 14*c* and 15*c* are substantially aligned respectively with walls 10*b*, 11*b*, 12*b*, 13*b*, 14*b* and 15*b*.

The space between wall 10*c* and wall 15*c* limited radially by the corresponding portions of inner tube 3 and sleeve tube 2*c* defines chamber 9*c*. The space between wall 15*c* and wall 14*c* limited radially by the corresponding portion of inner tube 3 and sleeve tube 2*c* defines a chamber 21*c*. Preferably, said walls 10*c*, 11*c*, 12*c*, 13*c*, 14*c* and 15*c* are welded on inner tube 3 as well as on separator disk 4*c* and separator disk 4*d* and are glued on outer tube 5*c*, both in a substantially sealed manner. Thus, the space defined between two successive walls (chosen among walls 10*c*, 11*c*, 12*c*, 13*c* and 14*c*) as well as the portions of inner tube 3 and outer tube 5*c* comprised between the latter forms a channel usable to transmit vacuum if relevant.

A curved oblong hole 23*c* is arranged in separator disk 4*c* between, on one hand, wall 12*b* and wall 12*c* and, on the other hand, wall 13*b* and wall 13*c*. Similarly, a curved oblong hole 23*b* is arranged in separator disk 4*b* between, on one hand, wall 12*a* and wall 12*b* and, on the other hand, wall 13*a* and wall 13*b*. Thus, the space between walls 12*a* and 13*a*, walls 12*b* and 13*b* and walls 12*c* and 13*c* limited radially by the corresponding portions of inner tube 3 and respectively outer tubes 5*a*, 5*b* and 5*b* defines channel 6*c* extending longitudinally from separator disk 4*d* to end disk 4*a*.

A separator disk 7*b* is arranged in press fit manner inside of inner tube 3 at substantially the same longitudinal level than separator disk 4*e* (described later in relation with fifth segment 1*e*) mounted outside of inner tube 3. Preferably, a seal 19*b* is disposed in a groove arranged on the circumference of separator disk 7*b* in order to provide a sealing between separator disk 7*b* and inner tube 3. Thus, the space inside of inner tube 3 comprised between separator disk 7*a* and separator disk 7*b* defines a sealed chamber 24.

Several holes 18*c* are arranged in the portion of inner tube 3 comprised between wall 10*c* and wall 15*c*, said holes allowing chamber 24 to communicate with chamber 9*b*. Similarly, several holes 18*c*' are arranged in the portion of inner tube 3 comprised between wall 12*c* and wall 13*c*, said holes allowing channel 6*c* to communicate with chamber 24. A curved oblong hole 23*a* is arranged in end disk 4*a* between wall 12*a* and wall 13*a*. An adapter 20*c* is mounted on the end of the segmented vacuum roll on the end disk 4*a* side which puts in communication hole 23*a* with an external vacuum generator (not shown). Thus, vacuum is transmitted from said vacuum generator to chamber 9*c* successively through hole 23*a*, channel 6*c* (comprising holes 23*b* and 23*c*), holes 18*c*', chamber 24 and holes 18*c*. As already mentioned, chamber 9*c* is delimited in outward direction by a circumference portion of sleeve tube 2*c* which is perforated. As a consequence, the vacuum effect will be exerted through the perforations of that circumference portion, i.e. it is the active portion of segment 1*c* of the segmented vacuum roll. On the other hand, no vacuum effect is exerted on the remaining circumference portion of sleeve tube 2*c*. Of course, the gap between sleeve tube 2*c* and outer tube 5*c* taken at the level of wall 10*c* is preferably minimized in order to avoid vacuum leakage. Similarly, the gap between sleeve tube 2*c* and wall 15*c* is also preferably minimized for the same reason.

As a result, when a web is placed on segment 1*c*, it will be sucked onto the active portion of sleeve tube 2*c* through the action of vacuum existing in chamber 9*c*. Further, when sleeve tube 2*c* is caused to rotate, it will drive the web. The means for causing sleeve tube 2*c* to rotate will be described later.

Figure 6:
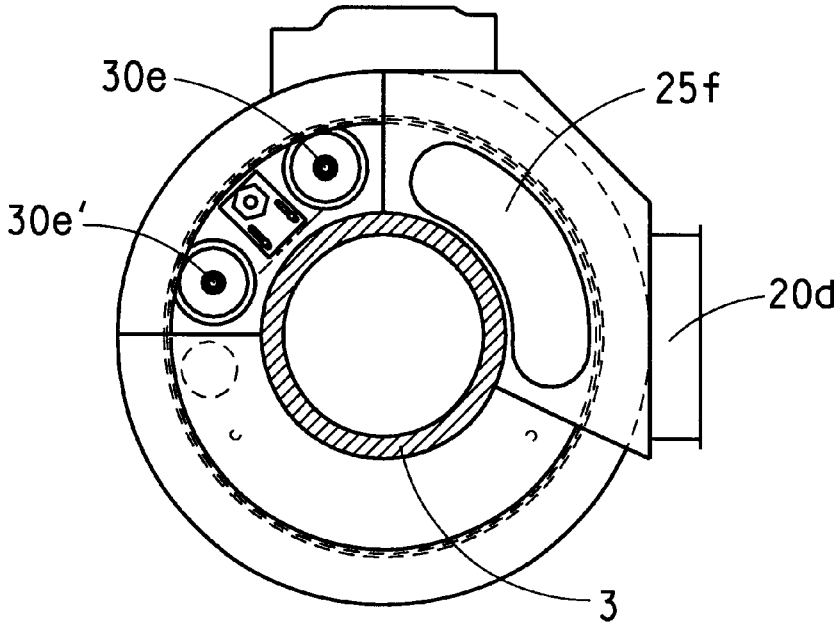
FIG. 6 schematically shows a cross section of the segmented vacuum roll of FIG. 1 according to line 6—6.
Figure 7:
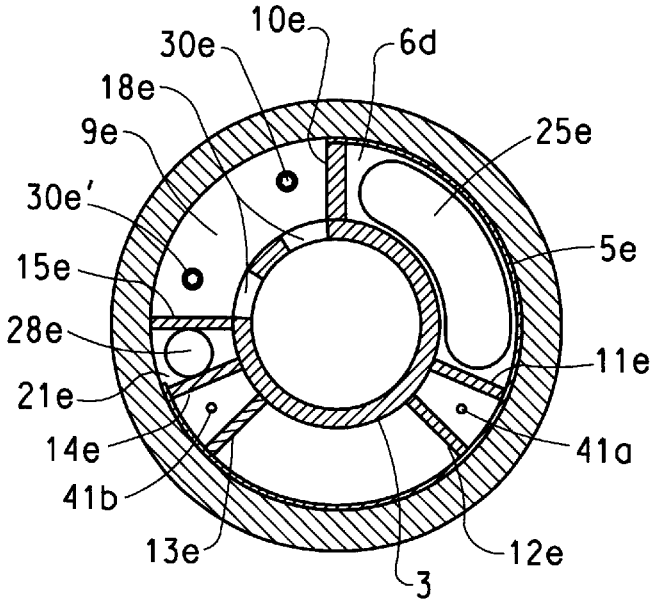
FIG. 7 schematically shows a cross section of the segmented vacuum roll of FIG. 1 according to line 7—7.
Figure 8:
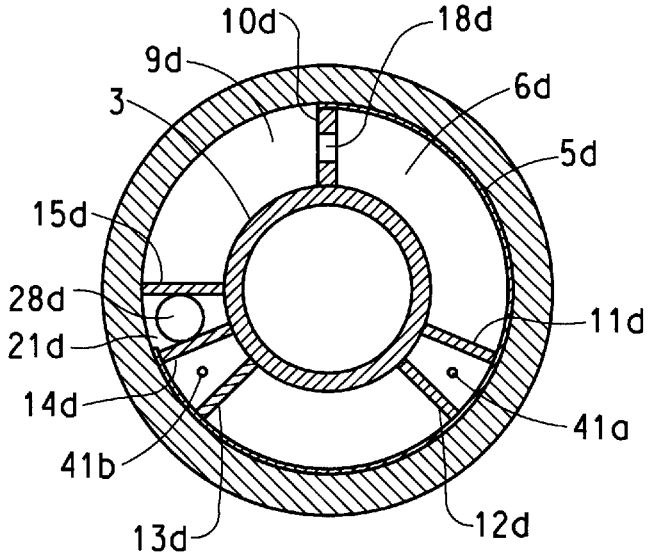
FIG. 8 schematically shows a cross section of the segmented vacuum roll of FIG. 1 according to line 8—8.

Fifth segment 1*e* will be described in relation with FIGS. 1*b*, 6, and 7.

Fifth segment 1*e* is designed symmetrically to first segment 1*a*. Fifth segment 1*e* comprises sleeve tube 2*e*. Sleeve tube 2*e* is rotatably mounted by each end on inner tube 3 via an end disk 4*f* on the free end side of the segmented vacuum roll (opposite to the side with end disk 4*a*) and via a separator disk 4*e* on the side towards end disk 4*a*. End disk 4*f* as well as separator disk 4*e* have a central hole corresponding substantially to the outer diameter of inner tube 3 so that they may be mounted on the latter. The joint between end disk 4*f* and inner tube 3 and the joint between separator disk 4*e* and inner tube 3 are preferably welded in a substantially sealed manner. Sleeve tube 2*e* is rotatably mounted on end disk 4*f* and separator disk 4*e* via respectively a ball bearing 17*f* and a first ball bearing 17*e*.

Outer tube 5*e* is mounted coaxially on inner tube 3 between end disk 4*f* and separator disk 4*e*. Outer tube 5*e* has preferably substantially the same outer diameter than end disk 4*f* and separator disk 4*e*, but it could also be smaller. As a result, sleeve tube 2*e* surrounds also outer tube 5*e*. Five longitudinal walls 10*e*, 11*e*, 12*e*, 13*e*, and 14*e* extend preferably radially between inner tube 3 and outer tube 5*e* in spaced relationship from one another around the circumference of inner tube 3. The circumference portion of outer tube 5*e* comprised between wall 10*e* and wall 14*e* is omitted so that the space comprised between wall 10*e* and wall 14*e* is limited in outward direction by the corresponding circumference portion of sleeve tube 2*e*. A further longitudinal wall 15*e* extending preferably radially is arranged on inner tube 3 between wall 10*e* and 14*e*. Walls 10*e*, 11*e*, 12*e*, 13*e*, 14*e* and 15*e* extend longitudinally from end disk 4*f* to separator disk 4*e*.

The space between wall 10*e* and wall 15*e* limited radially by the corresponding portion of inner tube 3 and sleeve tube 2*e* defines chamber 9*e*. The space between wall 15*e* and wall 14*e* limited radially by the corresponding portion of inner tube 3 and sleeve tube 2*e* defines a chamber 21*e*. Preferably, said walls 10*e*, 11*e*, 12*e*, 13*e*, 14*e* and 15*e* are welded on inner tube 3 as well as on end disk 4*f* and separator disk 4*e* and are glued on outer tube 5*e*, both in a substantially sealed manner. Thus, the space defined between two successive walls (chosen among walls 10*e*, 11*e*, 12*e*, 13*e* and 14*e*) as well as the portions of inner tube 3 and outer tube 5*e* comprised between the latter forms a channel usable to transmit vacuum if relevant.

Two holes 18*e* are arranged on inner tube 3 between walls 10*e* and 15*e* so that chamber 9*e* communicates with the inside of inner tube 3. As already mentioned, separator disk 7*b* is arranged in press fit manner inside of inner tube 3 at substantially the same longitudinal level than separator disk 4*e* mounted outside of inner tube 3. Preferably, a seal 19*b* is disposed in a groove arranged on the circumference of separator disk 7*b* in order to provide a sealing between separator disk 7*b* and inner tube 3. The inside of inner tube 3 corresponding to segment 1*e* side (i.e. the portion of inner tube 3 extending from separator disk 7*b* towards the end of inner tube 3 on the side of end disk 4*f*) forms channel 6*e* connected at its free end to a vacuum generator (not shown) via a sleeve 20*e*. Thus, vacuum is transmitted from said vacuum generator to chamber 9*e* successively through sleeve 20*e*, channel 6*e* and holes 18*e*. As already mentioned, chamber 9*e* is delimited in outward direction by a circumference portion of sleeve tube 2*e* which is perforated. As a consequence, the vacuum effect will be exerted through the perforations of that circumference portion, i.e. it is the active portion of segment 1*e* of the segmented vacuum roll. On the other hand, no vacuum effect is exerted on the remaining circumference portion of sleeve tube 2*e*. Of course, the gap between sleeve tube 2*e* and outer tube 5*e* taken at the level of wall 10*e* is preferably minimized in order to avoid vacuum leakage. Similarly, the gap between sleeve tube 2*e* and wall 15*e* is also preferably minimized for the same reason.

As a result, when a web is placed on segment 1*e*, it will be sucked onto the active portion of sleeve tube 2*e* through the action of vacuum existing in chamber 9*e*. Further, when sleeve tube 2*e* is caused to rotate, it will drive the web. The means for causing sleeve tube 2*e* to rotate will be described later.

Fourth segment 1*d* will be described in relation with FIGS. 1*b*, 6, 7 and 8.

Fourth segment 1*d* is designed as second segment 1*b*, but symmetrically. Fourth segment 1*d* comprises sleeve tube 2*d*. Sleeve tube 2*d* is rotatably mounted by each end on inner tube 3 via separator disk 4*d* on the side towards third segment 1*c* and via separator disk 4*e* on the side towards fifth segment 1*e*. Sleeve tube 2*d* is rotatably mounted on separator disk 4*d* via a second ball bearing 17*d* arranged aside first ball bearing 17*d* which supports sleeve tube 2*c*. Sleeve tube 2*d* is further rotatably mounted on separator disk 4*e* via a second ball bearing 17*e* arranged aside first ball bearing 17*e* which supports sleeve tube 2*e*.

Outer tube 5*d* is mounted coaxially on inner tube 3 between separator disk 4*d* and separator disk 4*e*. Outer tube 5*d* has preferably substantially the same outer diameter than separator disks 4*d* and 4*e*, but it could also be smaller. As a result, sleeve tube 2*d* surrounds also outer tube 5*d*. Five longitudinal walls 10*d*, 11*d*, 12*d*, 13*d* and 14*d* extend preferably radially between inner tube 3 and outer tube 5*d* in spaced relationship from one another around the circumference of inner tube 3. The circumference portion of outer tube 5*d* comprised between wall 10*d* and wall 14*d* is omitted so that the space comprised between wall 10*d* and wall 14*d* is limited in outward direction by the corresponding circumference portion of sleeve tube 2*d*. A further longitudinal wall 15*d* extending preferably radially is arranged on inner tube 3 between wall 10*d* and 14*d*. Walls 10*d*, 11*d*, 12*d*, 13*d*, 14*d* and 15*d* extend longitudinally from separator disk 4*d* to separator disk 4*e*. Further, walls 10*d*, 11*d*, 12*d*, 13*d*, 14*d* and 15*d* are substantially aligned respectively, on one hand, with walls 10*c*, 11*c*, 12*c*, 13*c*, 14*c* and 15*c* and, on the other hand, with walls 10*e*, 11*e*, 12*e*, 13*e*, 14*e* and 15*e*.

The space between wall 10*d* and wall 15*d* limited radially by the corresponding portions of inner tube 3 and sleeve tube 2*d* defines chamber 9*d*. The space between wall 15*d* and wall 14*d* limited radially by the corresponding portion of inner tube 3 and sleeve tube 2*d* defines a chamber 21*d*. Preferably, said walls 10*d*, 11*d*, 12*d*, 13*d*, 14*d* and 15*d* are welded on inner tube 3 as well as on separator disk 4*d* and separator disk 4*e* and are glued on outer tube 5*d*, both in a substantially sealed manner. Thus, the space defined between two successive walls (chosen among walls 10*d*, 11*d*, 12*d*, 13*d* and 14*d*) as well as the portions of inner tube 3 and outer tube 5*d* comprised between the latter forms a channel usable to transmit vacuum if relevant.

A curved oblong hole 25*e* is arranged in separator disk 4*e* between, on one hand, wall 10*d* and wall 10*e* and, on the other hand, wall 11*d* and wall 11*e*. Thus, the space between walls 10*d* and 11*d* and walls 10*e* and 11*e* limited radially by the corresponding portions of inner tube 3 and respectively outer tubes 5*d* and 5*e* defines channel 6*d* extending longitudinally from separator disk 4*d* to end disk 4*f*. Several holes 18*d* are arranged in wall 10*d* allowing channel 6*d* to communicate with chamber 9*d*. A curved oblong hole 25*f* is arranged in end disk 4*f* between wall 10*e* and wall 11*e*. An adapter 20*d* is mounted on the end of the segmented vacuum roll on the end disk 4*f* side which puts in communication hole 25*f* with an external vacuum generator (not shown). Thus, vacuum is transmitted from said vacuum generator to chamber 9*d* successively through hole 25*f*, channel 6*d* (comprising hole 25*e*) and holes 18*d*. As already mentioned, chamber 9*d* is delimited in outward direction by a circumference portion of sleeve tube 2*d* which is perforated. As a consequence, the vacuum effect will be exerted through the perforations of that circumference portion, i.e. it is the active portion of segment 1*d* of the segmented vacuum roll. On the other hand, no vacuum effect is exerted on the remaining circumference portion of sleeve tube 2*d*. Of course, the gap between sleeve tube 2*d* and outer tube 5*d* taken at the level of wall 10*d* is preferably minimized in order to avoid vacuum leakage. Similarly, the gap between sleeve tube 2*d* and wall 15*d* is also preferably minimized for the same reason.

As a result, when a web is placed on segment 1*d*, it will be sucked onto the active portion of sleeve tube 2*d* through the action of vacuum existing in chamber 9*d*. Further, when sleeve tube 2*d* is caused to rotate, it will drive the web. The means for causing sleeve tube 2*d* to rotate will be described later.

As a result from what has been described up to now, the segmented vacuum roll comprises five vacuum roll segments 1*a*, 1*b*, 1*c*, 1*d* and 1*e* rotatable independently from one another. The active portion of each segment 1*a*, 1*b*, 1*c*, 1*d* and 1*e* (i.e. the portion of corresponding sleeve tube 2*a*, 2*b*, 2*c*, 2*d* and 2*e* through which the vacuum effect will exert on webs placed on the segmented vacuum roll) is preferably about 90°. In other words, walls 10*a* and 15*a*, wall 10*b* and 15*b*, walls 10*c* and 15*c*, walls 10*d* and 15*d* and walls 10*e* and 15*e* respectively form an angle of about 90°. FIG. 3 illustrates a web 27*a* driven by segment 1*a*. Web 27*a* arrives substantially horizontally on segment 1*a* and contacts it approximately at the beginning of its active portion (i.e. at the level of wall 10*a* which is consequently arranged vertically). Web 27*a* leaves segment 1*a* vertically and downwards at a level corresponding approximately to the end of its active portion (i.e. at the level of wall 15*a* which is consequently arranged horizontally). Of course, sleeve tube 2*a* is caused to rotate clockwise in the example of FIG. 3. The other segments 1*b*, 1*c*, 1*d* and 1*e* work similarly. It may be taken from FIGS. 2, 3, 4, 5, 6, 7 and 8 that two tie rods 41*a* and 41*b* passes through the whole segmented vacuum roll. Tie rod 41*a* passes in the channel formed between walls 11*a* and 12*a*, walls 11*b* and 12*b*, walls 11*c* and 12*c*, walls 11*d* and 12*d* and walls 11*e* and 12*e* delimited radially by the corresponding portions of inner tube 3 and outer tubes 5*a*, 5*b*, 5*c*, 5*d* and 5*e*, the corresponding portions of separator disks 4*b*, 4*c*, 4*d* and 4*e* having a hole for passing tie rod 41*a*. Similarly, tie rod 41*b* passes in the channel formed between walls 13*a* and 14*a*, walls 13*b* and 14*b*, walls 13*c* and 14*c*, walls 13*d* and 14*d* and walls 13*e* and 14*e* delimited radially by the corresponding portions of inner tube 3 and outer tubes 5*a*, 5*b*, 5*c*, 5*d* and 5*e*, the corresponding portions of separator disks 4*b*, 4*c*, 4*d* and 4*e* having a hole for passing tie rod 41*b*. Tie rods 41*a* and 41*b* are threaded and provided with nuts at both ends and are tightened in such a way that the deflection of the vacuum roll is cancelled.

The segmented vacuum roll may also comprise an air shower in order to ensure that the webs will not adhere on its inactive portions (i.e. the portions of sleeve tubes 2*a*, 2*b*, 2*c*, 2*d* and 2*e* where no vacuum effect is exerted on the webs) which would result in an unwished winding of the webs on the segmented vacuum roll. The air shower is obtained by blowing air into chambers 21*a*, 21*b*, 21*c*, 21*d* and 21*e*. For that purpose, a hole 28*b*, 28*c*, 28*d* and 28*e* is arranged respectively in each separator disk 4*b*, 4*c*, 4*d* and 4*e* between respectively walls 14*a* and 15*a*, walls 14*b* and 15*b*, walls 14*c* and 15*c*, walls 14*d* and 15*d* and walls 14*e* and 15*e*. Thus, chambers 21*a*, 21*b*, 21*c*, 21*d* and 21*e* are in communication one by one. An external air generator (not shown) is connected on a further hole 28*a* arranged in end disk 4*a* between walls 14*a* and 15*a*. Alternately, it is possible to connect a further air generator on a hole arranged in end disk 4*f* between walls 14*e* and 15*e*. As a result, air will flow through the perforations of the portions of sleeve tubes 2*a*, 2*b*, 2*c*, 2*d* and 2*e* corresponding respectively to chambers 21*a*, 21*b*, 21*c*, 21*d* and 21*e* and will cause the webs to leave the segmented vacuum roll at this location. Alternately, it is also possible to connect each chamber 21*a*, 21*b*, 21*c*, 21*d* and 21*e* to a respective air generator in which case holes 28*b*, 28*c*, 28*d* and 28*e* are omitted and air transmission from the air generators to the respective chambers could be ensured with channels similarly to vacuum transmission for chambers 9*a*, 9*b*, 9*c*, 9*d* and 9*e*.

The segmented vacuum roll may also be adapted to the overall width of the web. For that purpose, segment 1*a* comprises two longitudinal screws 30*a* and 30*a*' extending in chamber 1*a* between end disk 4*a* and separator disk 4*b*. Screws 30*a* and 30*a*' are mechanically coupled to each other (e.g. by means of a timing belt) and guide and actuate an isolation part 29*a*. The outer shape of isolation part 29*a* substantially corresponds to the cross section of chamber 9*a* so that isolation part 29*a* divides chamber 9*a* into two sub chambers 9*a*' and 9*a*" substantially sealingly isolated from one another. Preferably, a seal 32*a* is arranged into a groove formed in the outer surfaces on the side of inner tube 3 and of walls 10*a* and 15*a*. On the other hand, the gap between isolation part 29*a* and sleeve tube 2*a* is preferably minimized. The longitudinal position of isolation part 29*a* is adjustable by driving screws 30*a* and 30*a*' from the outside. Holes 18*a* arranged on inner tube 3 are preferably located near separator disk 4*b*. Thus, solely the resulting sub chamber 9*a*' comprised between isolation part 29*a* and separator disk 4*b* is connected to the external vacuum generator via channel 6*a*. On the contrary, the sub chamber 9*a*" comprised between isolation part 29*a* and end disk 4*a* is not fed with vacuum. As a result, the active portion of sleeve tube 2*a* is longitudinally limited to the length of sub chamber 9*a*'. Practically, when the web (split in several webs) is placed on the segmented vacuum roll, it is possible to adapt the position of isolation part 29*a* so that its longitudinal location substantially corresponds to the external edge of the web on segment 1*a*. Thus, there is no vacuum leakage through the portion of sleeve tube 2*a* not covered by the web.

Symmetrically, segment 1*e* comprises the same features. Two longitudinal screws 30*e* and 30*e*' extend in chamber 1*e* between end disk 4*f* and separator disk 4*e*. Screws 30*e* and 30*e*' are mechanically coupled to each other (e.g. by means of a timing belt) and guide and actuate an isolation part 29*e*. The outer shape of isolation part 29*e* substantially corresponds to the cross section of chamber 9*e* so that isolation part 29*e* divides chamber 9*e* into two sub chambers 9*e*' and 9*e*" substantially sealingly isolated from one another. Preferably, a seal 32*e* is arranged into a groove formed in the outer surfaces on the side of inner tube 3 and of walls 10*e* and 15*e*. On the other hand, the gap between isolation part 29*e* and sleeve tube 2*e* is preferably minimized. The longitudinal position of isolation part 29*e* is adjustable by driving screws 30*e* and 30*e*' from the outside. Holes 18*e* arranged on inner tube 3 are preferably located near separator disk 4*e*. Thus, solely the resulting sub chamber 9*e*' comprised between isolation part 29*e* and separator disk 4*e* is connected to the external vacuum generator via channel 6*e*. On the contrary, the sub chamber 9*e*" comprised between isolation part 29*a* and end disk 4*f* is not fed with vacuum. As a result, the active portion of sleeve tube 2*e* is longitudinally limited to the length of sub chamber 9*e*'. Practically, when the web (split in several webs) is placed on the segmented vacuum roll, it is possible to adapt the position of isolation part 29*e* so that its longitudinal location substantially corresponds to the external edge of the web on segment 1*e*. Thus, there is no vacuum leakage through the portion of sleeve tube 2*e* not covered by the web.

Of course, isolation parts 29*a* and 29*e* may be moved by any other means known in the art.

Figure 9:
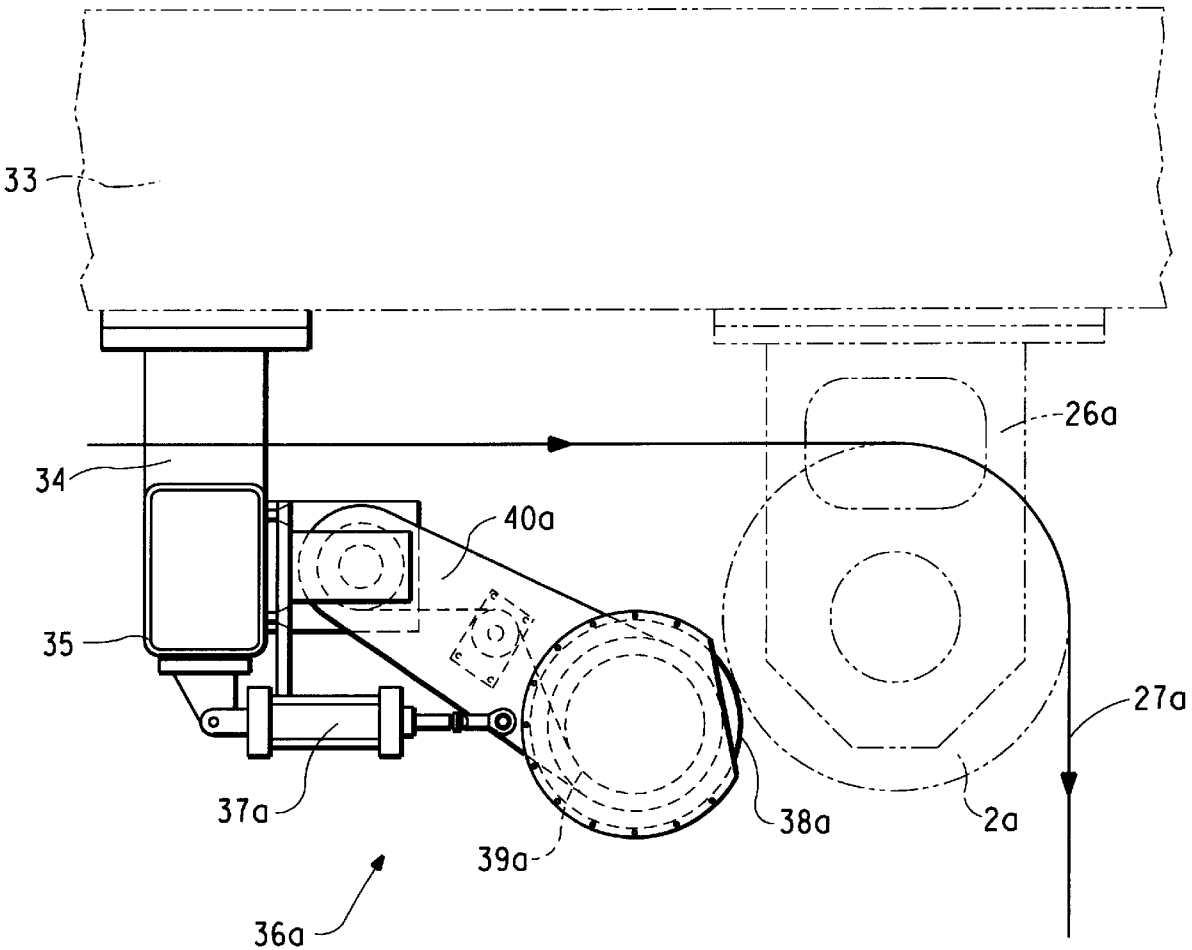
FIG. 9 schematically shows a lateral view of the segmented vacuum roll of FIG. 1 completed with the driving arrangement for its segments.

In reference to FIG. 9, we will now describe the means for driving sleeve tube 2*a* in rotation. FIG. 9 is a lateral view of the segmented vacuum roll: only its mounting support 26*a* and sleeve tube 2*a* are depicted (in dot-and-dash lines). The segmented vacuum roll is fixed onto a frame 33. A girder 35 having a square section extending parallel to the segmented vacuum roll is mounted on frame 33 horizontally spaced from the segmented vacuum roll. Girder 35 is somewhat longer than the segmented vacuum roll and is fixed on frame 33 by its ends so as to leave a free space 34 between girder 35 and frame 33 through which the overall wide of the split web arrives onto the segmented vacuum roll. A driving apparatus 36*a* mounted on girder 35 is provided for driving sleeve tube 2*a* in rotation. A motor (not shown) is fixed on girder 35. An arm 40*a* extending towards the segmented vacuum roll and slightly downwards is articulated on girder 35. A friction roller 38*a* is rotatably mounted on the free end of arm 40*a*. Friction roller is driven by a motor (not shown) mounted on girder 35 through a driving belt device 39*a*. A pneumatic cylinder 37*a* the housing of which is rotatably mounted on girder 35 has its rod rotatably linked on arm 40*a*. Thus, pneumatic cylinder allows friction roller 38*a* to engage or disengage sleeve tube 2*a*. As a result, friction roller 38*a* allows to drive in rotation sleeve tube 2*a*.

Four other driving apparatuses (not shown) similarly designed are mounted on girder 35 in spaced relationship for driving in rotation respectively sleeve tube 2*b*, 2*c*, 2*d* and 2*e*.

As a result, each segment 1*a*, 1*b*, 1*c*, 1*d* and 1*e* of the segmented vacuum roll is driven by a respective motor and so, may rotate at an own speed.

However, this segmented vacuum roll may also be used for driving one large web extending, for instance, from segment 1*a* to segment 1*e* due to the fact that all sleeve tubes 2*a*, 2*b*, 2*c*, 2*d* and 2*e* have the same outer diameter and are aligned.

Alternately, it is also possible to use a respective external belt drive instead of friction rollers for driving each sleeve 2*a*, 2*b*, 2*c*, 2*d* and 2*e*. To drive each of sleeves 2*a*, 2*b*, 2*c*, 2*d* and 2*e*, it is also possible to use a respective gear transmission arranged internally to the sleeve tubes 2*a*, 2*b*, 2*c*, 2*d* and 2*e*; in this case, it may be gears with built-in motors or gears coupled to motors arranged externally, on the ends of the segmented vacuum roll via shafts.

Alternately, there might be no driving means at all for driving sleeves 2*a*, 2*b*, 2*c*, 2*d* and 2*e*. The segmented vacuum roll behaves then as an idle segmented vacuum roll: thus, sleeves 2*a*, 2*b*, 2*c*, 2*d* and 2*e* are driven by their respective webs.

In the described embodiment, each sleeve tube 2*a*, 2*b*, 2*c*, 2*d* and 2*e* has a diameter of 540 mm and a length of about 1100 mm, thus the overall length of the segments is about 5500 mm. Of course, these sizes may be changed. The inner assembly is preferably made of steel material.

The invention was described in reference to a preferred embodiment. However, many variations are possible within the scope of the invention.

For instance, inner tube 3 may be not cylindrical as well as the outer tubes 5*a*, 5*b*, 5*c*, 5*d* and 5*e*. The number of walls between inner tube 3 and outer tubes 5*a*, 5*b*, 5*c*, 5*d* and 5*e* may be varied, depending in particular on the number of channels wished for transmitting vacuum to respective segments. Similarly, the several channels (for transmitting vacuum to respective segments) formed between the walls as well as the inside of inner tube 3 may be defined differently and connected to other segments by distributing differently the holes in the separator disks 4*b*, 4*c*, 4*d* and 4*e* or placing differently separator disks 7*a* and 7*b* inside of inner tube 3. Also, further separator disks may be arranged inside of inner tube 3. It is easy to vary the number of independent segments of the segmented vacuum roll by varying the number of channels for transmitting vacuum.

What is claimed is:

1. A segmented vacuum roll comprising:

an inner assembly on which a plurality of cylindrical sleeve tubes having apertures over their circumference are rotatably and coaxially mounted side by side, each of said sleeve tubes being individually rotatable;

one or several first chambers formed in said inner assembly and partly defined by a first portion of circumference of said sleeve tubes, said inner assembly comprising linking means for linking a vacuum source to said chambers so that said first portion of circumference of said sleeve tubes may be submitted to vacuum.

2. The segmented vacuum roll according to claim 1, characterized in that each of said sleeve tubes corresponds to a respective one of said first chambers.

3. The segmented vacuum roll according to claim 1, characterized in that said linking means allow to link a respective vacuum source to each of said first chambers.

4. The segmented vacuum roll according to claim 1, characterized in that said first portion of circumference corresponds to about an angular sector of 90°.

5. The segmented vacuum roll according to claim 1, characterized in that, for one or both of said sleeve tubes located at the extremity of said vacuum roll, adjustable means prevent a longitudinal portion of selectable length at the free extremity of said sleeve tube from being submitted to vacuum.

6. The segmented vacuum roll according to claim 1, characterized in that at least one second chamber is formed in said inner assembly and partly defined by a second portion of circumference of said sleeve tubes, said inner assembly comprising means for linking said second chamber to an air generator so that air may be blown through the perforations of said second portion of circumference of said sleeve tubes.

7. The segmented vacuum roll according to claim 6, characterized in that said second portion of circumference of said sleeve tubes is located immediately after said first portion of circumference of said sleeve tubes.

8. The segmented vacuum roll according to claim 1, characterized in that said inner assembly comprises an inner tube, at least one outer tube surrounding said inner tube and a plurality of longitudinal walls extending between said inner tube and said outer tube so as to form longitudinal channels making part of said linking means.

9. The segmented vacuum roll according to claim 8, characterized in that at least one of said longitudinal channels is subdivided in at least two channels by at least one radial separation.

10. The segmented vacuum roll according to claim 8, characterized in that a portion of the circumference of said outer tube is omitted so that the cross section of said first chambers is defined by a portion of said inner tube, two of said longitudinal walls, and said first portion of circumference of said sleeve tubes.

11. The segmented vacuum roll according to claim 8, characterized in that a portion of the circumference of said outer tube is omitted so that the cross section of said second chambers is defined by a portion of said inner tube, two of said longitudinal walls, and said second portion of circumference of said sleeve tubes.

12. The segmented vacuum roll according to claim 8, characterized in that, for at least one of said first chambers, the corresponding linking means comprise an inner end portion of said inner tube.

13. The segmented vacuum roll according to claim 8, characterized in that, for at least one of said first chambers, the corresponding linking means comprise one of said longitudinal channels formed between said inner tube and said outer tube, and separated from said first chamber by at least one of said longitudinal walls, at least one hole being arranged in said longitudinal wall allowing vacuum communication between said longitudinal channel and said first chamber.

14. The segmented vacuum roll according to claim 8, characterized in that, for at least one of said first chambers, the corresponding linking means comprise an inner portion of said inner tube and one of said longitudinal channels formed between said inner tube and said outer tube, said first chamber being in vacuum communication with said longitudinal channel via said inner portion of said inner tube.

15. The segmented vacuum roll according to claim 1, characterized in that said sleeve tubes have the same outer diameter.

16. The segmented vacuum roll according to claim 1, characterized in that it further comprises driving means for driving in rotation each of said sleeve tubes independently from one another.

17. The segmented vacuum roll according to claim 16, characterized in that, for at least one of said sleeve tubes, said driving means comprise a friction roller external to said sleeve tubes.

* * * * *